US006578947B1

(12) United States Patent
Suwabe et al.

(10) Patent No.: US 6,578,947 B1
(45) Date of Patent: Jun. 17, 2003

(54) INK DRYING PREVENTION APPARATUS, INK-JET RECORDING HEAD STORAGE CONTAINER, INK-JET RECORDING APPARATUS AND INK DRYING PREVENTION METHOD

(75) Inventors: Yasufumi Suwabe, Nakai-machi (JP); Susumu Hirakata, Nakai-machi (JP); Satoshi Mohri, Nakai-machi (JP); Yuji Suemitsu, Nakai-machi (JP); Hiroaki Satoh, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/721,691

(22) Filed: Nov. 27, 2000

(30) Foreign Application Priority Data

Mar. 2, 2000 (JP) ..... 2000-057673
Aug. 24, 2000 (JP) ..... 2000-253608

(51) Int. Cl.[7] ..... B41J 2/165
(52) U.S. Cl. ..... 347/29
(58) Field of Search ..... 347/29, 45, 28, 347/85–87, 93, 95, 7, 108; 106/31.57; 206/204

(56) References Cited

U.S. PATENT DOCUMENTS 4,432,004 A * 2/1984 Glattli ..... 347/28
5,160,535 A * 11/1992 Cooke et al. ..... 106/31.57
5,231,416 A * 7/1993 Terasawa et al. ..... 347/23
5,341,160 A * 8/1994 Winslow et al. ..... 347/86
6,102,518 A * 8/2000 Taylor ..... 347/29
6,409,325 B1 * 6/2002 Matsumoto et al. ..... 347/87

FOREIGN PATENT DOCUMENTS

| | | | | |
|---|---|---|---|---|
| FR | 000681924 A1 | * | 11/1995 | |
| JP | 49-115548 | | 11/1974 | |
| JP | 52-104130 | | 9/1977 | |
| JP | 54-69436 | | 6/1979 | |
| JP | 357205157 A | * | 12/1982 | |
| JP | 359055757 A | * | 3/1984 | ..... 347/29 |
| JP | 4-357043 | | 12/1992 | |
| JP | 5-514 | | 1/1993 | |
| JP | 5-177841 | | 7/1993 | |
| JP | 406115088 A | * | 4/1994 | ..... 347/29 |

* cited by examiner

*Primary Examiner*—Shih-Wen Hsieh
(74) *Attorney, Agent, or Firm*—Morgan, Lewis & Bockius LLP

(57) ABSTRACT

The present invention provides an ink drying prevention apparatus that can prevent ink within an ink-jet recording head from drying, for a long period of time. The ink drying prevention apparatus prevents ink within an ink-jet recording head from drying, and includes a porous substance permeated with a seal liquid that is nonvolatile and incompatible with the ink within the head, wherein the porous substance can contact a nozzle surface of the ink-jet recording head. The seal liquid forms plural meniscuses in an interface with the nozzle surface and inside the porous substance to block air paths, thereby preventing ink within a nozzle exposed to the nozzle surface from drying.

21 Claims, 10 Drawing Sheets

INK DRYING PREVENTION APPARATUS, INK-JET RECORDING HEAD STORAGE CONTAINER, INK-JET RECORDING APPARATUS AND INK DRYING PREVENTION METHOD

BACKGROUND OF THE INVENTION

1. Field of the Invention

The present invention relates to an ink drying prevention apparatus, an ink-jet recording head storage container and an ink-jet recording apparatus that are provided therewith, and an ink drying prevention method.

2. Description of the Related Art

Conventionally, an ink-jet printer has been performing printing in a manner that jets ink from plural orifices formed on a nozzle plate of a jet nozzle and deposits the ink on a medium. If the above printer has been kept from printing for a long period of time, dry ink may cause the orifices to be clogged and dust may be deposited on the nozzle plate, so that a dot dropout may occur during printing, reducing printing quality or disabling printing. Accordingly, when recording will not be performed for a long period of time, when recording is to be performed with ink of a different color, or when a recording method is to be changed, the recording head is moved to a predetermined place within the ink-jet printer so that a drying prevention unit is activated to bring the printer to a stop, or the recording head having been used is removed from the ink-jet printer and housed in a storage container provided with a drying prevention unit.

As the above drying prevention unit, there is known one that a chamber corresponding to a jet nozzle is formed at the bottom and a rubber cap is disposed in the circumference of the chamber. By setting the recording head in the drying prevention unit with the jet nozzle facing the bottom, or by the recording head being slightly moved toward the drying prevention unit when the recording head is set in the drying prevention unit, the nozzle plate of the jet nozzle of the recording head is pressed against the cap, so that ink within the orifices is prevented from evaporating.

Conventionally, a variety of drying prevention units employing a cap are known. For example, caps used in the closed cap system are shaped so that they have no openings in other than portions abutting on a nozzle plate. Therefore, if a recording head is set in a drying prevention unit using a cap, since the chamber can be sealed, it can be prevented that dry ink causes orifices to be clogged and dust is deposited on the nozzle plate. As a result, it can be prevented that a dot dropout occurs during printing, reducing printing quality or disabling printing. With the closed cap system, however, since the chamber is sealed by mechanically pressing the nozzle plate of the jet nozzle against the cap, it is difficult to keep perfect sealing for a long period of time because of the existence of tiny foreign matters, flaws on surfaces of the nozzle plate, the deterioration of the elastic characteristics of the cap, change in a press state by travel of the recording head within a storage case, and the like. As a result, there is the problem that ink dries only a little over time, so that orifices are clogged. Also, if pressure within the chamber becomes high, since ink of the orifices returns to an ink tank, a dot dropout occurs, reducing printing quality or disabling printing.

As a system for solving the problem of the closed cap system, a system employing a cap having a air continuous hole is known. In a cap having the air continuous hole, since the difference of pressures inside and outside the chamber can be kept minimum by the air continuous hole providing communication between the chamber and the outside world, it can be prevented that ink within the orifices is pressed back to the ink tank. With the above system, however, since the air continuous hole provided on the cap causes ink to become drier, there is the problem that the orifices are clogged due to the dried ink in a shorter time than with the closed cap system.

Further improved systems are known; for example, the system of charging a cap with a liquid having the same component as ink and containing no color material, and the system of charging the cap with glycerin and diethylene glycol known as moisture retention materials. These systems prevent ink from drying by keeping the chamber under a saturated vapor pressure wherein the chamber is sealed or communicates partially with the air. These systems can solve the problem of ink being pressed by a change in pressure while preventing ink from drying for a longer period of time. However, since the liquid itself used evaporates and is lost over time, the liquid must be replenished as required to maintain the capability for a long period of time. Even in systems employing moisture retention materials relatively resistant to evaporation, it is difficult to prevent the loss of the liquid. In the above systems, as a liquid with which the cap is charged, one that is compatible with ink or has an affinity for the ink is used. Therefore, if ink within the orifices and the charged liquid contact each other, since a solution of two types of liquids or a mixed solution of them is produced, the characteristics of the ink are changed, making normal printing difficult. Moreover, a color material of the ink may mix with the liquid within the cap, causing color mixture.

SUMMARY OF THE INVENTION

The present invention has been made in view of the above circumstances and provides an ink drying prevention apparatus, an ink-jet recording head storage container, and an ink drying prevention method that can solve the above problems and prevent ink within an ink-jet recording head from drying for a long period of time. Also, the present invention provides an ink-jet recording apparatus that can prevent degradation in printing quality and disabled printing due to dried ink within an ink-jet recording head.

To solve the above problems, the present invention provides an ink drying prevention apparatus that prevents ink within an ink-jet recording head from drying, the ink drying prevention apparatus including a porous substance permeated with a seal liquid that is nonvolatile and incompatible with the ink within the head, wherein the porous substance can contact a nozzle surface of the ink-jet recording head.

In the ink drying prevention apparatus of the present invention, when the porous substance permeated with a seal liquid that is nonvolatile and incompatible with ink contacts on the nozzle surface of the ink-jet recording head, the seal liquid forms a large number of meniscuses of the seal liquid between the porous substance and the nozzle surface. As a result, a communication path between ink within a nozzle exposed to the nozzle surface and the outside world can be blocked. Since air gaps within the porous substance are charged with the seal liquid, a communication path in the porous substance in thickness direction is also completely blocked. Accordingly, ink within the nozzle is not exposed to the air around the recording head and nozzle clogging or solidification of the ink due to the drying can be relieved. Since the seal liquid is held within the porous substance by the capillary attraction of pores of the porous substance, it is not easily discharged to the outside and the ink drying prevention function can be maintained over a long period of time.

The present invention is an ink-jet recording head storage container provided with the ink drying prevention apparatus.

An ink-jet recording apparatus of the present invention includes an ink-jet recording head having the nozzle surface and the ink drying prevention apparatus supported so as to be contactable with the nozzle surface. The ink-jet recording apparatus may include a unit that, when ink is not jetted, brings the ink drying prevention apparatus into contact with the nozzle surface, and when ink is jetted, separates the ink drying prevention apparatus from the nozzle surface.

An ink drying prevention method of the present invention brings a porous substance permeated with a liquid that is nonvolatile and incompatible with ink, into contact with the nozzle surface of a recording head to prevent contact between the ink within the nozzle and the air, and prevents the ink within the ink-jet recording head from drying, wherein the seal liquid forms meniscuses between the porous substance and the nozzle surface.

In the ink drying prevention method, when the porous substance permeated with a seal liquid that is nonvolatile and incompatible with ink contacts on the nozzle surface of the ink-jet recording head, the seal liquid forms a large number of meniscuses of the seal liquid between the porous matte and the nozzle surface. As a result, a communication path between ink within a nozzle exposed to the nozzle surface and the outside world can be blocked. Since air gaps within the porous substance are charged with the seal liquid, a communication path in the porous substance in thickness direction is also completely blocked. Accordingly, ink within the nozzle is not exposed to the air around the recording head and nozzle clogging or solidification of the ink due to the drying of the ink can be relieved. Since the seal liquid is held within the porous substance by the capillary attraction of pores of the porous substance, it is not easily discharged to the outside and ink drying can be prevented over a long period of time.

BRIEF DESCRIPTION OF THE DRAWINGS

Preferred embodiments of the present invention will be described in detail based on the followings, wherein.

DESCRIPTION OF THE PREFERRED EMBODIMENTS

[Ink Drying Prevention Apparatus]

Figure 1:
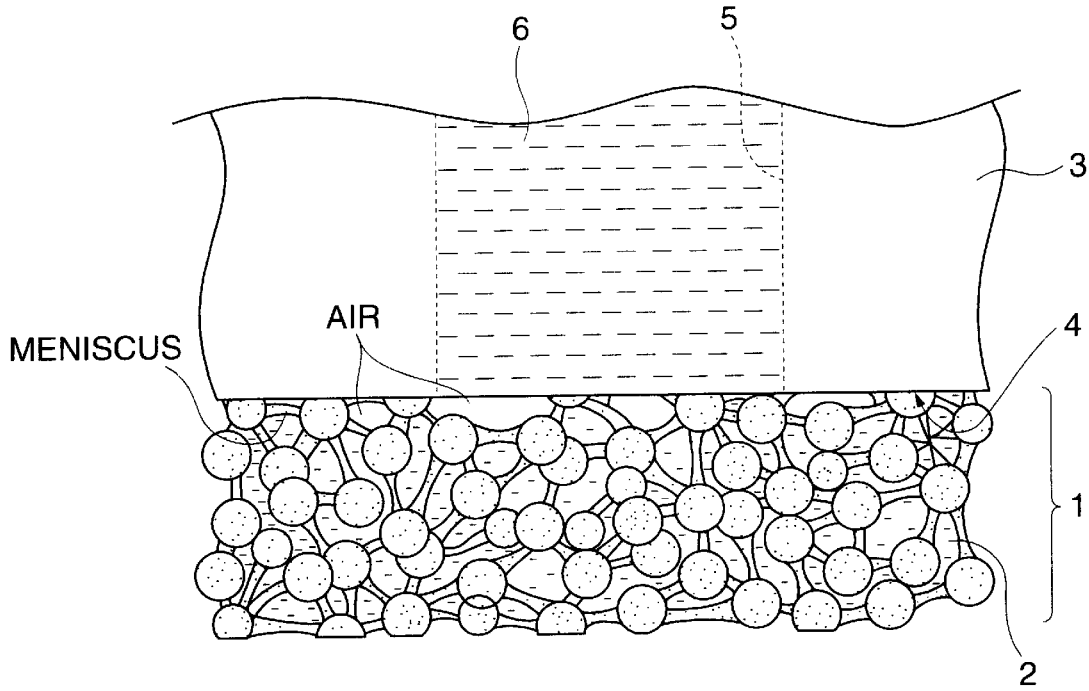
FIG. 1 is a schematic diagram conceptually showing the operation of an ink drying prevention apparatus of the present invention.

A drying prevention apparatus of the present invention includes a seal liquid and a porous substance permeated with the seal liquid. The ink drying prevention apparatus of the present invention has the porous substance disposed in contact with a nozzle surface of an ink-jet recording head so that one or more jet orifices provided on the nozzle surface of the recording head are sealed by a liquid held in the porous substance to prevent ink within the recording head, exposed to the jet orifices, from drying.

In the present invention, a seal liquid used to seal the nozzle surface of the recording head is nonvolatile. Accordingly, the seal liquid does not evaporate while the recording head is stored and there occurs no change in the state in which the ink jet orifices are sealed by the seal liquid. As a result, ink can be prevented from drying for a long period of time. It is desirable that the vapor pressure of the seal liquid is about 13.3 Pa (0.1 mmHg) or less at room temperature (25° C.).

Moreover, the seal liquid is incompatible with ink within the recording head. Accordingly, even if the seal liquid seals the jet orifices for a long period of time, the seal liquid does not mix with the ink and therefore color mixture and degradation of printing quality are unlikely to occur which will be caused if the seal liquid mixes with the ink. It is desirable that the solubility of the seal liquid to the ink is 0.1% or less by mass at room temperature (25° C.). Moreover, it is desirable that the seal liquid is repellent to ink used.

It is desirable that the seal liquid has the nature of easily permeating the pores of the porous substance. From this point of view, it is desirable that the seal liquid has small surface tension, preferably 30 or less mN/m. It is desirable that the kinematic viscosity of the seal liquid is 1 to 1000 $mm^2/s$ at room temperature. If the kinematic viscosity of the seal liquid is less than 1 $mm^2/s$, the evaporation amount of the seal liquid itself at room temperature increases to the point where it becomes difficult to keep the capability of the seal liquid for a long period of time. On the other hand, when the kinematic viscosity exceeds 1000 $mm^2/s$, resistance to the flow of the seal liquid becomes high and undesirably it takes a long time to permeate the porous substance.

When aqueous ink is used, organic solvents which are liquid at room temperature, and oils can be used as the seal liquid. To be more specific, the following are desirable: organic solvents such as octane, nonane, tetradecane, dodecane, oleic acid, linoleic acid, n-decanol, dimethylbutanol, dibutyl phthalate, and dibutyl maleate, and oils such as vegetable oil, mineral oil, silicon oil, and fluoric oil. These can be used singly, or plural types of them can be used in mixture if mixable uniformly. Also, a mixture of plural materials, adjusted to a desirable range of viscosity and surface tension, may be used.

The drying prevention apparatus of the present invention has a porous substance permeated with the seal liquid. It is desirable that the porous substance has an average pore diameter of 0.01 to 100 $\mu$m. Too small a pore diameter might make permeation of the seal liquid difficult and require a special method such as pressurization to allow a predetermined amount of the seal liquid to permeate the porous substance. Too large a pore diameter might weaken the retention power of meniscus. As a result, the seal liquid might transfer to the nozzle surface of the recording head and might be removed from the porous substance by external force such as vibration and impact, disabling the drying prevention capability. If the porosity of the porous substance is larger, the porous substance can be permeated with more seal liquid and the ink drying prevention capability can be maintained for a longer period of time, but an excessively large porosity might reduce mechanical strength. On the other hand, the smaller the porosity, the higher the mechanical strength, but an excessively small porosity might make perfect shielding from the air difficult and reduce the ink drying prevention capability.

It is desirable that the porous substance has an affinity for the seal liquid and is repellent to ink used. Specifically, it is desirable that the porous substance has surface energy with an ink contact angle of more than 90° to the surface of the porous substance and a seal liquid contact angle of 90° or less to the surface of the porous substance. If the surface energy is in the range, desirably, the depositing of ink on the porous substance can be prevented and the disturbance of ink within a nozzle of the recording head can be prevented. It is desirable that the porous substance has a pore structure capable of being permeated with a seal liquid and has pores so that the held seal liquid is exposed to a side in contact with the nozzle surface of the recording head. The porous substance may have a pore structure in which discrete pores exist discretely, or a strigose structure in which very thin fiber is woven. Also, a pore structure is also acceptable which is formed when a bundle of materials having a capillary structure such as hollow threads are bonded and sliced thin vertically to a capillary direction. Three-dimensional net structures found in various porous resins are particularly desirable. If a porous substance has a three-dimensional net structure, when permeating the porous substance with a seal liquid in the producing stage of an ink drying prevention apparatus or in the process of use of it, desirably, the seal liquid permeates the porous substance quickly and uniformly by only supplying the seal liquid to any location of the porous substance, so that a desired permeation state is obtained.

To increase the flexibility of the porous substance with the recording head nozzle surface and the hermeticity of the porous substance, it is desirable that the porous substance is a flexible member, particularly an extensible member such as a film. It is desirable that the porous resin, if used, has a thin layer of 1 mm or less in thickness. Porous resin films made of the following various materials are suitable: specifically, porous fluorocarbon resin (PTFE (tetrafluoroethylene polymer), PFA (tetrafluoroethylene, perfluoro vinyl ether copolymer), PVDF (polyfluorinated vinylidene), FEP (tetrafluoroethylene, hexafluoropropylene copolymer), ETFE (ethylene, tetrafluoroethylene copolymer), PCTFE (trifluoroethylene polymer), etc), porous polyolefin resin (PE (polyethylene), PP (polypropylene)), porous polysulfone resin (polysulfone polymer), porous polyester resin (PET (polyethylene terephthalate), PBT (polybutylene terephthalate)), porous polyamide resin (polyamide), porous polyimide resin (polyimide, polyamide), porous polyurethane resin (polyurethane), porous polyacryl resin (polyacrylonitrile polymer, metaacrylate alkyl ester, N-alkyl (meta) acrylamide, carboxy (meta)acrylate), porous polystyrene resin (hydroxystyrene resin), porous polyketone resin (polyester ketone resin), and porous silicon resin (silicon gel).

The porous resins can be produced using, e.g., a foaming method, a sintering method, a stretching method, an extraction method, a track etching method, a solvent phase separation method, or a phase transformation method, and an optimum method can be selected according to materials. For example, when a fluorocarbon resin is used, it is desirable to use the stretching method or the extraction method that does not perform thermal processing beyond the melting point of the resin. So-called unbaked porous fluorocarbon resins made porous by the above described processing are desirable because they are easy to deform and the contact with the nozzle surface of the recording head is made more intimate. Since fluorocarbon resins have repellency, they are desirable as porous substances when aqueous ink is used. When aqueous ink is used, a porous resin film, made of materials other than fluorocarbon resins, provided with repellency by producing a coat on it through the applying, spraying, or dipping by use of a fluorocarbon resin is desirably used as the porous substance.

Since the porous substance has many internal pores, the seal liquid can be held within the porous substance by capillary attraction within the pores. By balancing the capillary attraction of the seal liquid within the pores with a negative pressure within the head that is acting on the ink meniscuses of the nozzle, the seal liquid can be held in the porous substance and the invasion of the seal liquid into the nozzle can be prevented. It is desirable that the permeation ratio of the seal liquid, that is, the ratio of contained seal liquid to the total pore volume of the porous substance, does not exceed 100% in the storage state in which the recording head presses against the porous substance. If 100% is exceeded, a seal liquid overflowing from the porous substance may invade into the nozzle of the recording head and the jet capability of the recording head may be deteriorated. Although an initial proper permeation ratio is decided by the average pore diameter and compression property of a porous substance used, a head contact pressure to be applied, and the like, it is desirable to make a design taking apparatus design tolerances into account so that a permeation ratio during use does not exceed 100% even in an unexpected situation.

An ink drying prevention apparatus of the present invention brings a porous substance permeated with a seal liquid that is nonvolatile and incompatible with ink, into contact with a nozzle surface of an ink-jet recording head to suppress contact between the ink and the air, thereby preventing the ink within the nozzle of the ink-jet recording head from drying. The ink drying prevention apparatus of the present invention is characterized in that the seal liquid forms meniscuses between the porous substance and the nozzle surface. FIG. 1 is a conceptual diagram showing a state in which the seal liquid permeates a porous substance. In FIG. 1, the seal liquid 2 permeating a porous substance 1 makes contact with a nozzle surface 4 of a recording head 3 at an interface between the nozzle surface 4 of the recording head 3 and the porous substance 1. The seal liquid 2 is held in the porous substance 1, and at a contact portion with the nozzle surface 4 of the recording head 3, a trace quantity of the seal liquid 2 makes contact with the nozzle surface 4. As a result, meniscuses are formed by the seal liquid 2 between the nozzle surface 4 and the porous substance 1 and a communication path between ink 6 in a nozzle 5 exposed to the nozzle surface 4 and the outside world can be blocked. If the diameter of pores of the porous substance 1 is sufficiently small, since an infinite number of meniscuses are formed around the nozzle surface 4, the nozzle 5 is firmer sealed. Since air gaps within the porous substance 1 are charged with the seal liquid 2, a communication path in the porous substance 1 in thickness direction is also completely blocked. As a result, ink 6 within the nozzle 5 is not exposed to the air around the recording head 3 and the clogging of the nozzle 5 does not occur that might be caused when the ink 6 becomes dry or coagulates. Although, in FIG. 1, air exists in the interface between the porous substance 1 and the nozzle surface 4, the air remains in trace amounts when the porous substance 1 and the nozzle surface 4 make contact with each other, and the condition of its existence may differ a little depending on the condition of contact between the porous substance 1 and the nozzle surface 4, and the condition of permeation of the seal liquid 2 into the porous substance 1. The air, regardless of its condition, is shielded from the outside air by the seal liquid 2 contained in the porous substance 1 and exerts little influence on the evaporation of moisture from the nozzle.

Since the seal liquid 2 is nonvolatile and held within the porous substance 1 by the capillary attraction of pores, it is not easily discharged from the porous substance 1 and the ink drying prevention function can be maintained for a long period of time. Moreover, since the seal liquid 2 is incompatible with ink 6 used, when the seal liquid 2 contacts the ink 6, they separate from each other without becoming compatible, and the separated ink and seal liquid can be easily removed by dummy jet or the like. Accordingly, the jet capability of the recording head 3 is not badly affected.

The seal liquid held in the porous substance may be consumed due to accidental factors such as external impact or time-dependent factors such as movement from the porous substance to the nozzle surface. As the seal liquid is consumed, air gaps not charged with the seal liquid increase within the porous substance. When ink within the ink-jet recording head invades into the air gaps, the seal liquid has difficulty in staying on the surface of the porous substance and the seal liquid has difficulty in forming meniscuses on the surface of the porous substance. As a result, the ink drying prevention capability tends to degrade. Moreover, if, e.g., an extensible member such as film is used as the porous substance to increase the degree of contact with the nozzle surface, as the ink invades into the air gaps, extensibility (e.g., flexibility as film) tends to degrade along with reduction in the degree of contact with the nozzle face. Accordingly, also in terms of this point, the ink drying prevention capability tends to degrade.

To prevent ink from invading into the air gaps and more stably keep the ink drying prevention capability at a high level, it is desirable that the surface tension $\gamma_p$ of the porous substance and the surface tension $\gamma_s$ of the seal liquid are respectively smaller than the surface tension $\gamma_i$ of the ink. That is, it is desirable that $\gamma_p<\gamma_i$ and $\gamma_s<\gamma_i$. If $\gamma_s<\gamma_i$, the ink has difficulty in invading into the porous substance charged with the seal liquid, and further if $\gamma_p<\gamma_i$, the ink has difficulty in invading into the air gaps of the porous substance yielded by the consumption of the seal liquid. Accordingly, by selecting materials satisfying the above relation, the ink drying prevention capability can be more stably kept at a high level. It is desirable that the above relation is satisfied at least at room temperature (25° C.). Herein, the surface tension of the porous matter means the critical surface tension of solid of the porous matter (the bulk of the porous matter).

To prevent ink from invading into the air gaps and stably keep the ink drying prevention capability at a high level, it is desirable that the surface tension $\gamma_s$ of the seal liquid is smaller than the surface tension $\gamma_p$ of the porous substance, that is, $\gamma_s<\gamma_p$. If $\gamma_s<\gamma_p$, by charging the porous substance with a seal liquid having a smaller surface tension, the ink would have more difficulty in spreading wetly than it had before the porous substance was charged with the seal liquid. As a result, even if the seal liquid is consumed accidentally or due to time-dependent factors and air gaps occur in the porous substance, the ink has difficulty in invading into the air gaps once wetted by the seal liquid. Therefore, by selecting materials satisfying the relation, the invasion of ink into the air gaps can be prevented and the ink drying prevention capability can be stably kept at a high level. It is desirable that the above relation is satisfied at least at room temperature (25° C.).

In terms of stably keeping the ink drying prevention capability at a high level, more preferably, a relation $\gamma_s<\gamma_p<\gamma_i$ is satisfied among the surface tensions of a seal liquid, porous substance, and ink. For example, when aqueous ink is used as ink, the surface tension is about 30 to 50 mN/m. Accordingly, combinations of materials of a seal liquid and a porous substance desirably used together with aqueous ink are a combination of silicon oil ($\gamma_s$=20 mN/m) and polyolefin ($\gamma_p$=30 mN/m), a combination of silicon oil ($\gamma_s$=20 mN/m) and PVF ($\gamma$=28 mN/m), and a combination of silicon oil and PVDF ($\gamma_p$=25 mN/m).

When the seal liquid within the porous substance is consumed accidentally or due to time-dependent factors and air gaps occur in the porous substance, in order to prevent the ink from invading into the air gaps, it is desirable that a relation $P_2<P_1$ is satisfied, where $P_1$ is the pressure with which the seal liquid advances wetly to the porous substance, and $P_2$ is the pressure with which the ink advances wetly to the air gaps. Herein, $P_1$ and $P_2$ are calculated by the following expressions.

$$P_1=(4\times\gamma_s\times\cos\theta_s)\times\phi \quad (1)$$

$$P_2=(4\times\gamma_i\times\cos\psi_i)\times\phi \quad (2)$$

In the expressions (1) and (2), $\phi$ represents the diameter of pores of the porous substance, and $\gamma_s$ and $\gamma_i$ represent the surface tensions of the seal liquid and ink, respectively. $\theta_s$ represents the contact angle of the seal liquid to the bulk of the porous substance and $\psi_i$ represents the contact angle of the ink to the bulk of the porous substance the surface of which is wetted by the seal liquid. $\psi_i$ can be measured by putting ink on a coat of the seal liquid on the bulk surface of the porous substance.

From the expressions (1) and (2), to satisfy a relation $P_2<P_1$, a relation of $\gamma_i\times\cos\psi_i<\gamma_s\times\cos\theta_s$ is derived. Accordingly, by selectively using materials satisfying a relation $\gamma_i\times\cos\psi_i<\gamma_s\times\cos\theta_s$, for the seal liquid, porous substance, and ink, even if the seal liquid has been consumed, the invasion of the ink into the porous substance can be prevented and the ink drying prevention capability can be more stably kept. It is desirable that the above relational expressions are satisfied at least at room temperature (25° C.).

The shape of the ink drying prevention apparatus of the present invention is not limited to a specific one if a porous substance is contactable with a nozzle surface of a recording head. The ink drying prevention apparatus of the present invention may have a size which allows a seal liquid contained in the porous substance to seal jet orifices formed on the nozzle surface of the recording head.

In the ink drying prevention apparatus of the present invention, it is preferred that the contact angle of the seal liquid to the nozzle surface near the ink jet orifices is greater than that to the surface of the porous substance. When the contact angle of the seal liquid satisfies the above relationship, the seal liquid is repelled much more from the nozzle surface near the ink jet orifices than from the porous substance. Thus, for example, when the recording head is taken out from the ink drying prevention apparatus for using the recording head, most of the seal liquid that has formed a meniscus between the porous substance and the nozzle surface is moved to and remained in the porous substance than to the nozzle surface according to the movement of the remove of the recording head from the porous substance.

In order to set the relationship of the contact angle described above, for example, the nozzle surface at least near the ink jet orifices of the recording head may be treated with an ink repelling treatment. As the ink repelling treatment method, for example, a method for applying and drying a coating liquid dissolving a fluorine contained polymers to the nozzle surface near the ink jet orifices, a method for printing and baking a fluorine contained polymers to the nozzle surface near the ink jet orifices and a method for eutectoid plating the nozzle surface near the ink jet orifices in a fluorinated atmosphere or the like may be used. The contact angle of the seal liquid to the nozzle surface not near to the ink jet orifices may not be greater than that to the porous substance, it may be smaller or equal to the contact angle to the porous substance. However, it is preferred that contact angle of the seal liquid to the whole nozzle surface is set to greater than to the porous member, in other word, the whole area of the nozzle surface is treated with the ink repelling material, since the seal liquid is hard to remain on the whole area of the nozzle surface and contrary, most of the seal liquid is remained in the porous member when the recording head is removed form the surface of the porous substance. Thus, the total amount of the seal liquid to be remained on the nozzle surface is minimized and consumed amount of the seal liquid is also minimized.

Hereinafter, embodiments of an ink drying prevention apparatus of the present invention will be described using the accompanying drawings. An ink drying prevention apparatus shown in FIG. 2A has a porous substance 12 formed of a porous resin film or the like, and a seal liquid 14. The seal liquid 14 is held in the porous substance 12. As shown in FIG. 2A, the porous substance 12 is disposed opposite a nozzle surface 104 of a recording head 102, and the clogging of the nozzle 106 is prevented by the seal liquid 14 held in the porous substance 12. The porous substance 12 has only to contact the nozzle surface 104 of the recording head 102; for example, the porous substance 12 may be temporarily brought into contact with the nozzle surface 104 by an adhesive tape to store the recording head 102.

Figure 2B:
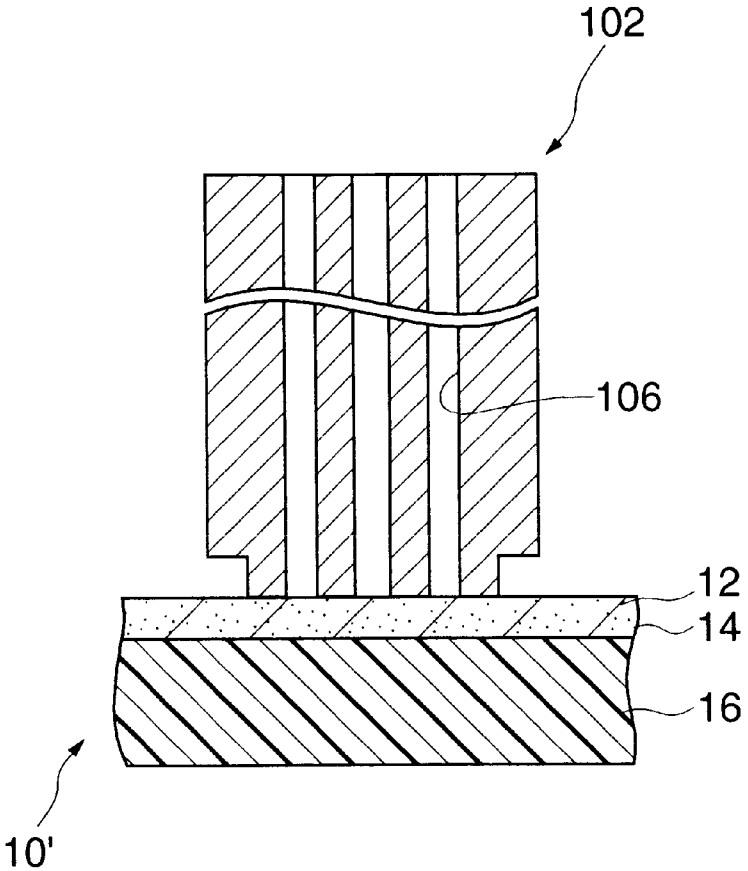
FIGS. 2A and 2B are schematic cross-sectional views showing an embodiment of the ink drying prevention apparatus of the present invention.
Figure 2A:
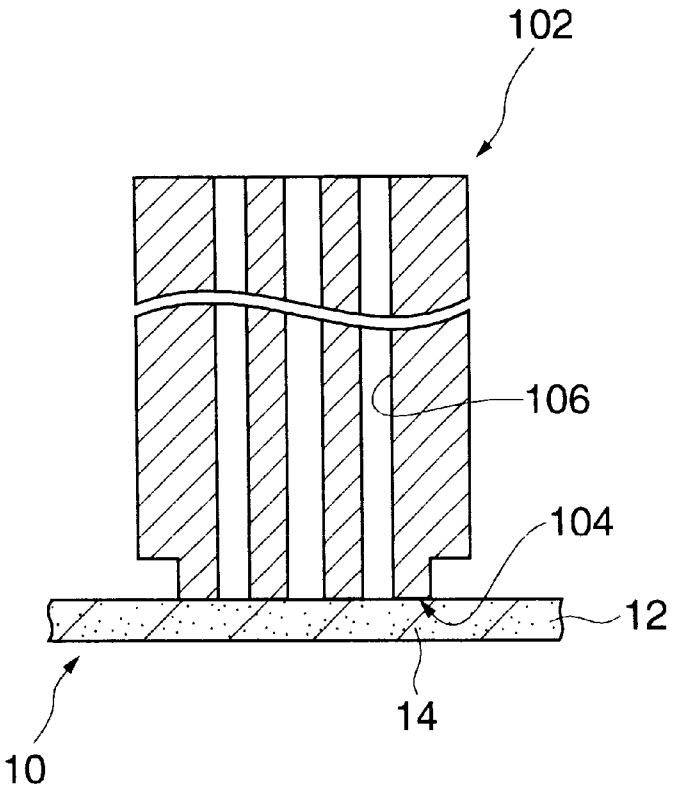

An ink drying prevention apparatus 10' shown in FIG. 2B secures the porous substance 12 holding the seal liquid 14 to a supporter 16. If the porous substance 12 is filmy, the porous substance 12 may be secured to the supporter 16 at a place except an area contacting with the recording head 102 to stretch the porous substance 12 on the surface of the supporter 16 under tension. The supporter 16 and the porous substance 12 may be bonded by applying an adhesive to an opposing face thereof. In this case, it is desirable, before permeating the porous substance with the seal liquid, to bond the porous substance to the supporter and dry the adhesive.

It is desirable that the supporter 16 is deformable. If the supporter is deformable, the supporter is deformed when the porous substance is pressed against the nozzle surface of the recording head, desirably the porous substance is brought into more intimate contact with the nozzle surface. There are no special limitations on the supporter, except that if it is deformable and is neither degraded nor deteriorated by a seal liquid used. However, an elastically deformable supporter is desirable because it is advantageous in repeated use. If the supporter is formed of an elastic substance, since a repulsive force is obtained on press and a pressing state can be persistently formed by the repulsive force, a stabler contact state can be easily obtained. It is desirable that, when an elastic substance is used as the supporter, an elastic substance of low elasticity having a Young's modulus of less than $10^2$ MPa is used. When the recording head is pressed against the elastic substance to bring the nozzle surface into intimate contact with the porous substance, if an elastic modulus is greater than $10^2$ MPa, undesirably a press amount must be controlled with high accuracy because of greater repulsive force for the deformation.

As materials of the elastic substance, in addition to elastic substances such as various rubbers and elastomers, the following can be used: various macromolecular materials molded in porous structure, such as polyurethane foam, polyethylene foam, polystyrene foam, polyvinyl chloride foam, rubber foam, and the like. When macromolecular porous foams are used as the supporter, since a lower porosity makes a compression stress value higher, a porosity of 30% or higher is desirable. As the supporter and other examples, bag-like materials doped with gelled macromolecular materials, gases, liquid, or powder particles are also applicable. This type of materials freely deformed on pressure is different from elastic substances in that they apply no unnecessary stress on the recording head and the drying prevention apparatus during storage. Therefore, even if there is a foreign matter between the porous substance and the nozzle surface, no persistent stress concentrates on it, preventing the porous substance and the nozzle surface from being damaged.

Figure 3:
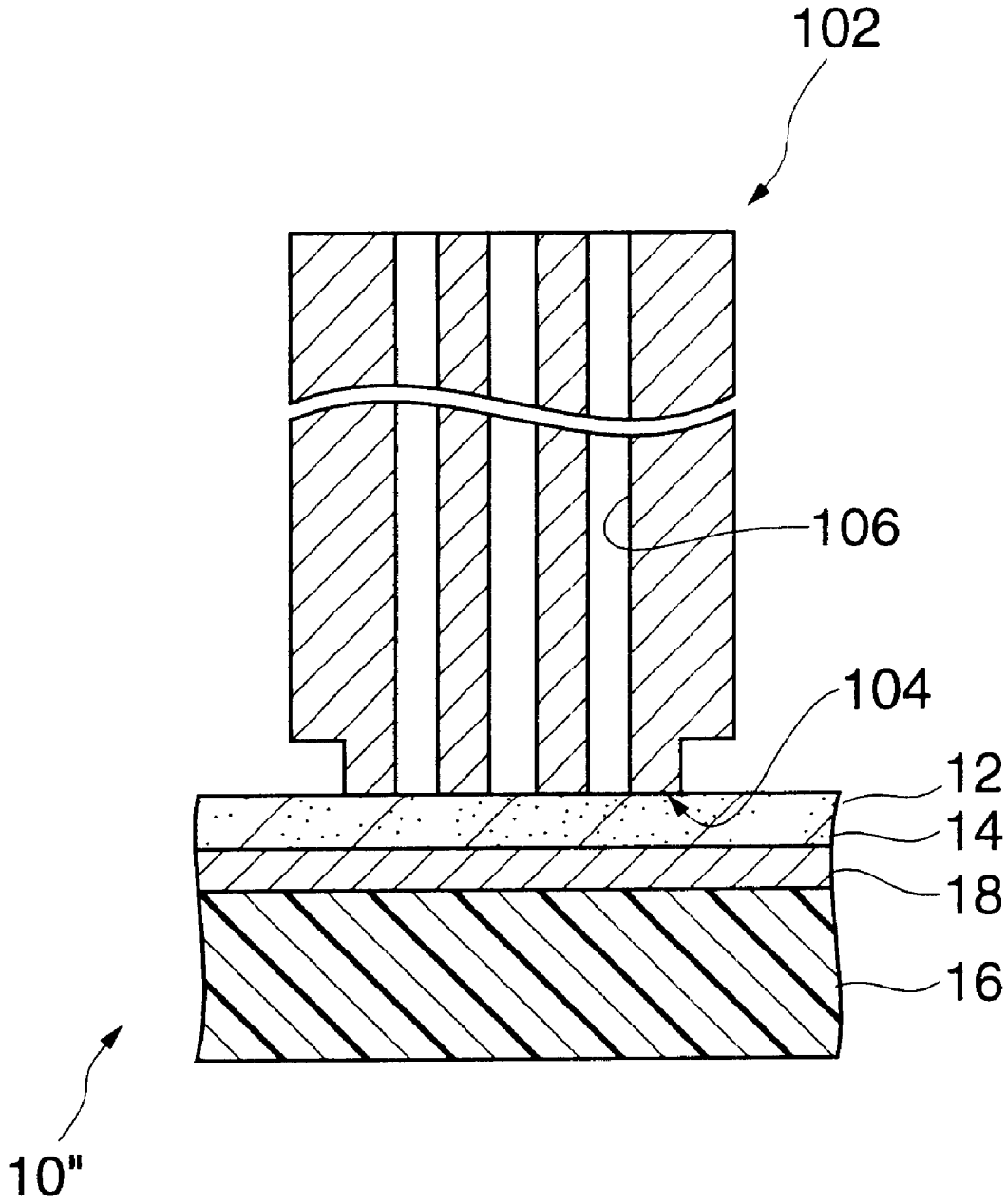
FIG. 3 is a schematic cross-sectional view showing an embodiment of the ink drying prevention apparatus of the present invention.

FIG. 3 shows an ink drying prevention apparatus 10" of another embodiment of the present invention. The ink drying prevention apparatus 10" includes a shielding member 18 provided between the supporter 16 and the porous substance 12 made of a porous resin and the like that contains the seal liquid 14. The shielding member 18 disables the passage of the seal liquid 14 and prevents the seal liquid 14 in the porous substance 12 from being absorbed to the supporter 16. Materials of the shielding member 18 may be whatever are capable of blocking the flow of the seal liquid 14; various resin materials, metallic materials, and the like are usable. A filmy shielding member 18 is desirable because it does not hamper an intimate contact between the nozzle surface 104 of the recording head 102 and the porous substance 12. For example, preferably, the shielding member 18 is a resin film or foil. The shielding member 18 may be integrally formed on an opposing face of the porous substance 12 of the supporter 16. For example, a resin film is formed on an opposing face of the supporter 16 by using a producing method such as the spray method, dip method, and spin coat method, and the resin film may be used as the shielding member 18. Alternatively, a thin metal film is formed on an opposing face of the supporter 16 by using a deposition method such as the vapordeposition method and sputtering method, and the metal film may be used as the shielding member 18.

Figure 4B:
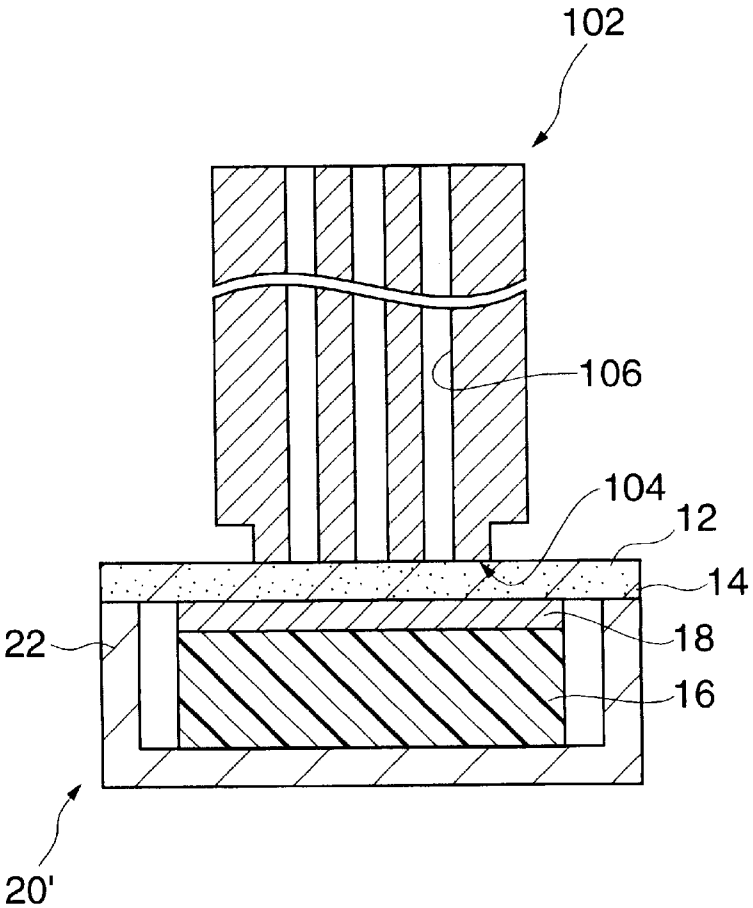
FIGS. 4A and 4B are schematic cross-sectional views showing an embodiment of the ink drying prevention apparatus of the present invention.
Figure 4A:
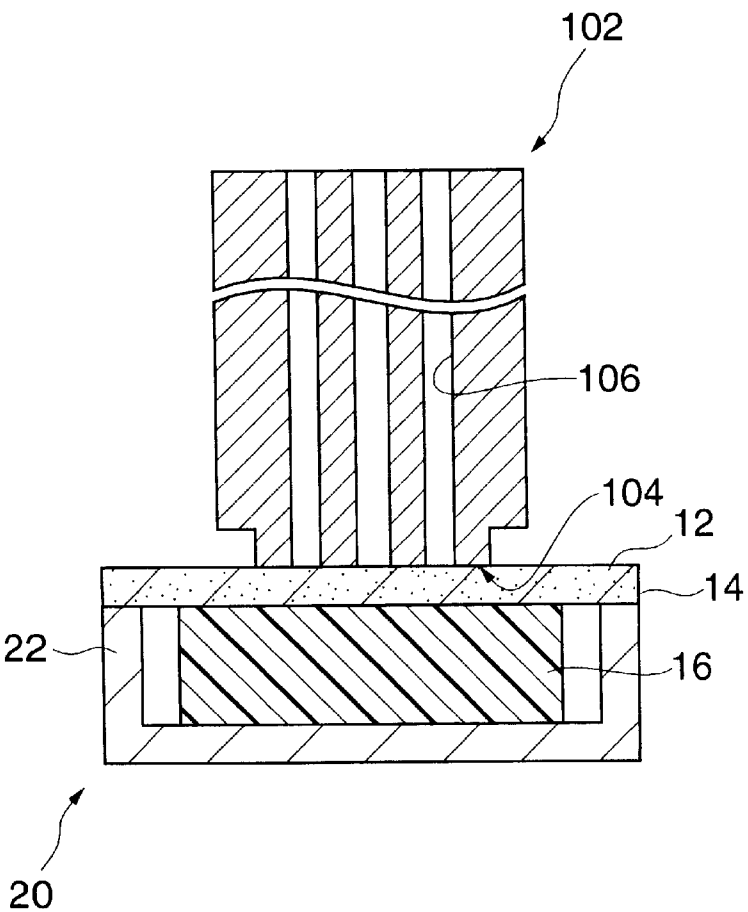

FIGS. 4A and 4B show ink drying prevention apparatuses 20 and 20' of another embodiment. The ink drying prevention apparatus has a deformable supporter 16 formed of an elastic substance or the like secured in a concave portion of a housing 22, on top of which the porous substance 12 permeated with the seal liquid 14 is provided. The ink drying prevention apparatus 20' has a shielding member 18 disposed between the supporter 16 of the ink drying prevention apparatus 20 and the porous substance 12. In the ink drying prevention apparatuses 20 and 20', members each are united and can be used as parts of an ink-jet recording apparatus and a recording head storage container.

It is desirable that the ink drying prevention apparatus of the present invention has a supplying unit that supplies a seal liquid to the porous substance. If the ink drying prevention apparatus has the supplying unit, even if repeated use of the ink drying prevention apparatus causes part of a seal liquid contained in the porous substance to be deposited on the nozzle surface of the recording head and be lost, since a seal liquid is supplied, the drying of ink within the recording head can be stably and longer prevented. Preferably, the closer the position of the supplying unit is to a contact portion between the porous substance and the nozzle surface of the recording head, the greater the contribution to the prevention of reduction in a seal liquid supply speed and unnecessary use of the seal liquid.

Figure 5:
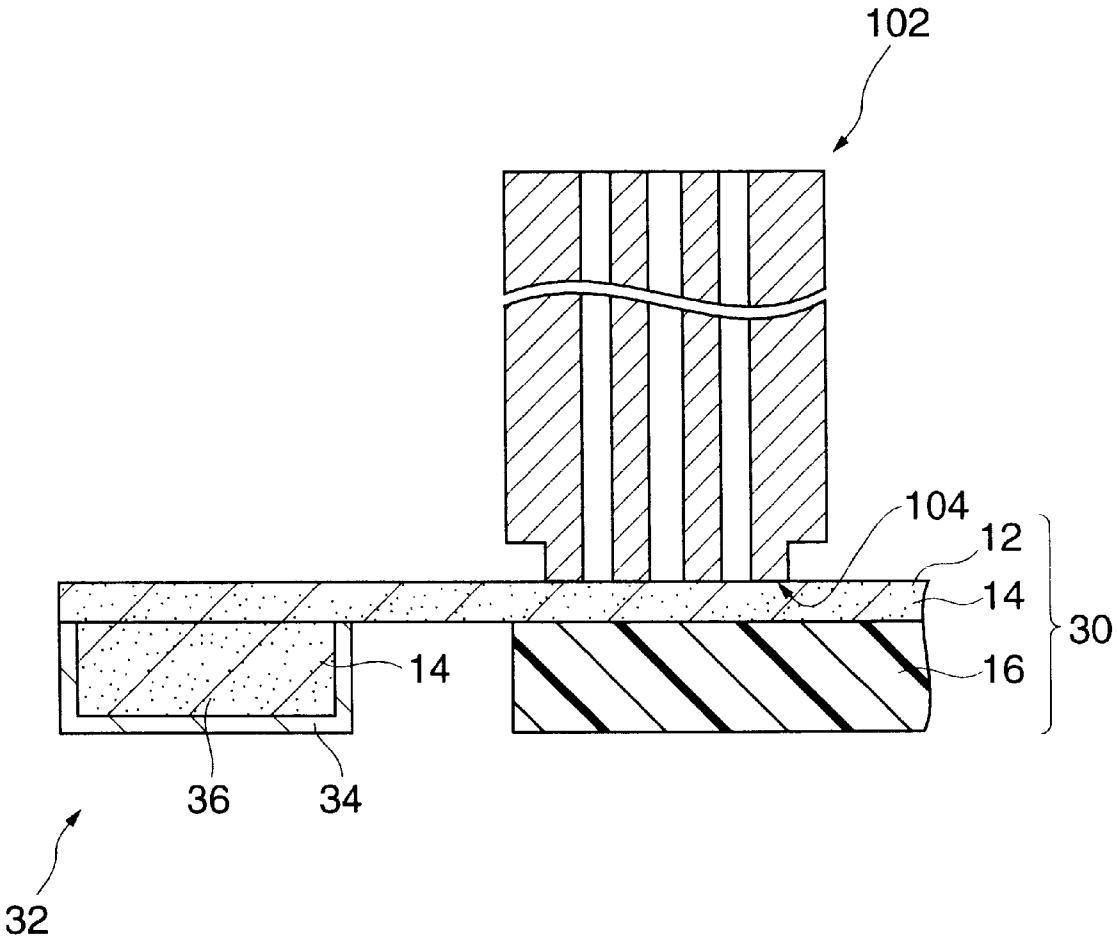
FIG. 5 is a schematic cross-sectional view showing an embodiment of the ink drying prevention apparatus of the present invention.

FIG. 5 shows an embodiment of an ink drying prevention apparatus having a supplying unit. Members shown in FIG. 5 that are identical to members shown in FIG. 2 are identified by the same reference numbers, and detailed descriptions thereof are omitted.

An ink drying prevention apparatus 30 is equivalent to the ink drying prevention apparatus 10' to which a supplying unit is further added. The supplying unit 32 includes a container 34 and a porous member 36 (holding member) disposed within the container 34. The porous member 36 holds a seal liquid 14 and supplies the seal liquid 14 to the porous substance 12 through contact with the porous substance 12.

Although the porous member 36 and the porous substance 12 have only to contact each other, they may be joined at their contact portion to prevent them from going out of contact due to accidental collision or the like. For example, they may be bonded using an adhesive (partially bonded so as not to hinder the supply of a seal liquid), or they may be joined by press-welding them at the side walls of the container 34 to prevent them from separating.

The porous member 36 can supply the seal liquid 14 to the porous substance 12 using the difference of capillary attractions. That is, when the pore diameter of the porous substance 12 is $r_1$, the contact angle of a seal liquid to the bulk of the porous substance 12 is $\theta_1$, the pore diameter of the porous member 36 is $r_2$, and the contact angle of a seal liquid to the bulk of the porous member 36 is $\theta_2$, if a relational expression below is satisfied at least in both contact portions, by bringing the porous member 36 and the porous substance 12 into contact, the seal liquid 14 held in the porous member 36 can be supplied to the porous substance 12. Accordingly, it is desirable to select materials of the porous member 36, the porous substance 12, and the seal liquid 14 so as to satisfy the relational expression below.

$$(\cos \theta_1/r_1)>(\cos \theta_2/r_2)$$

As the porous member 36, materials of porous structure can be used which are neither degraded nor deteriorated by a seal liquid used and satisfy the above relational expression. Particularly, it is desirable to use materials having porous structure with continuous air gaps such as fibrous materials and paper materials, on the surface of which surface and internal continuous fine grooves can contact the porous substance 12. Examples are various sponges, foams, non-woven fabrics, felts, clothes, synthetic resins exemplified previously as usable porous substances, so-called foams such as polyurethane foams, polyethylene foams, and polystyrene foams that have open cells, and foamed rubbers. For example, when silicon oil is used as the seal liquid 14, a porous PTFE film as the porous substance 12, and a polyurethane foam as the porous member 36, $r_1$ is about 0.5 $\mu$m, $\theta_1$ is about 30°, $r_2$ is about 50 $\mu$m, and $\theta_2$ is about 0°, and the above relational expression $(\cos \theta_1/r_1)>(\cos \theta_2/r_2)$ is satisfied because $\cos \theta_1/r_1=1.73\ \mu m^{-1}$ and $\cos \theta_2/r_2=0.02\ \mu m^{-1}$. Although it is desirable that the permeation ratio of the seal liquid 14 in the porous member 36 is greater because the seal liquid 14 is supplied to the porous substance 12 more satisfactorily, preferably the permeation ratio is about 60% to prevent the seal liquid 14 from leaking due to an accidental collision or the like.

Aside from the method of supplying the seal liquid 14 from the porous member 36 to the porous substance 12, a method can be employed for sucking the seal liquid 14 only by the capillary attraction of the porous substance 12 without using the capillary attraction of the porous member 36. For example, by forming a state in which the permeation ratio of the seal liquid 14 in the porous member 36 is 100% or more at a contact portion between the porous substance 12 and the porous member 36, the seal liquid can be stably supplied to the porous substance 12. To form a state in which the permeation ratio is 100% or more in the neighborhood of a contact portion with the porous substance 12, for example, gravity may be used, or by unevenly compressing the porous member 36, the seal liquid 14 held in the porous member 36 may be made to exist biasedly at a contact portion with the porous substance 12.

FIGS. 6A to 6D show examples of the supplying unit that can form a state in which the permeation ratio of a seal liquid exceeds 100%. In a supplying unit 38, the porous substance 12 is disposed at the bottom of a container 34 and contacts a porous member 36' disposed thereon. The seal liquid 14 held in the porous member 36' is pulled downward by gravity and the permeation ratio becomes 100% or more in the neighborhood of a contact portion. As a result, the seal liquid 14 is stably supplied to the porous substance 12. In the supplying unit 38, in order that the seal liquid 14 held in the porous member 36' is pulled downward by gravity (gravity>capillary attraction), of the porous materials exemplified in the porous member 36, preferably, those having a relatively large pore diameter are used. For example, when silicon oil is used as the seal liquid 14 and a polyurethane foam is used as the porous member 36', materials having a pore diameter of 100 $\mu$m or more are desirable for use, and for more stable supply of a seal liquid, materials having a pore diameter of 100 $\mu$m or more and of 1 mm or less are desirable for use. As in a supplying unit 38', it is desirable that a lid 40 is attached to an upper portion of the container 34 and the porous member 36' is pressed against the porous substance 12 by the lid 40. The lid 40 is bent at the right angle in a tip thereof not secured to the container 34 and an extension part a of the porous substance 12 is formed between the tip and a side wall of the container 34. By pressing the porous member 36' by the tip of the lid 40, a seal liquid concentrates readily in the extension part a so that the seal liquid 14 can be more stably supplied to the porous substance 12. Since the porous member 36' is sealed by the lid 40, the seal liquid 14 has difficulty in leaking even when the apparatus is inverted.

Figure 6C:
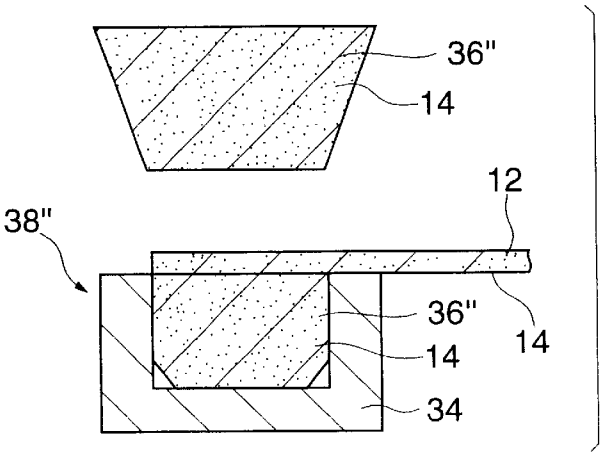
FIGS. 6A to 6D are diagrams showing a configuration of a supplying unit usable in the ink drying prevention apparatus of the present invention.
Figure 6D:
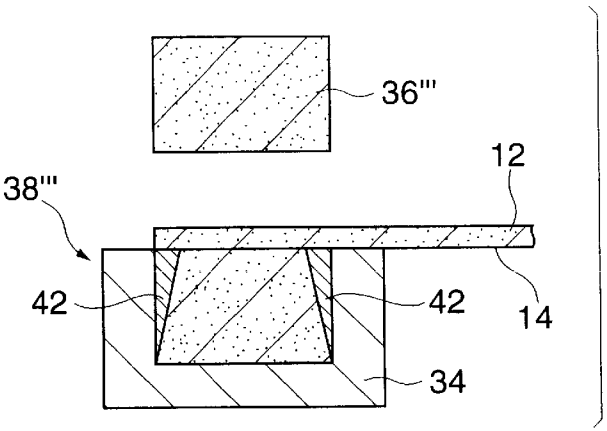
Figure 6A:
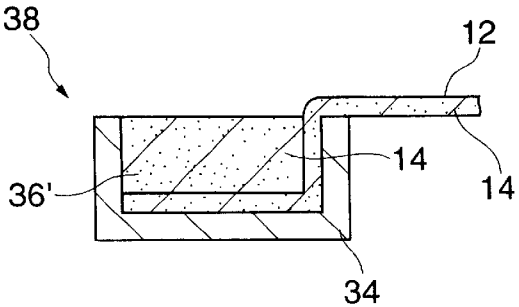
Figure 6B:
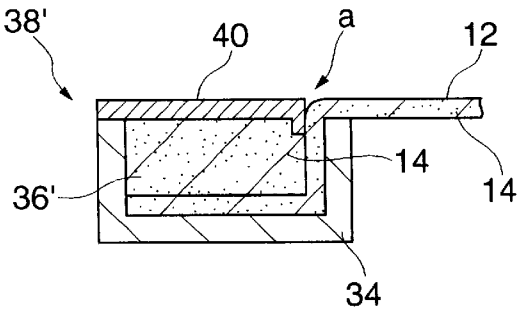

Supplying units 38" and 38'" of FIGS. 6C and 6D stably supply the seal liquid 14 to the porous substance 12 by increasing capillary attraction of porous members 36" and 36'" toward a contact portion with the porous substance 12 (in the drawings, the shapes of the porous members 36' and 36" before being disposed in the container 34 are also shown). The porous member 36" of the supplying unit 38"

increase in cross-sectional area toward a contact portion with (an upper portion in FIG. 6) with the porous substance 12. Since the porous member 36" increase in cross-sectional area toward a contact portion with the porous substance 12, it is unevenly compressed by the container 38 and its pore diameter decreases toward a contact portion with the porous substance 12. That is, the capillary attraction of the porous member 36" increases toward a contact portion with the porous substance 12. Accordingly, the seal liquid 14 concentrates in a contact portion with the porous substance 12 and a state in which permeation ratio is 100% or more is formed in the neighborhood of the contact portion. On the other hand, in the supplying unit 38'", ribs 42 are formed in the inside walls of the container 34', and the porous member 36'" is more firmly compressed toward a contact portion (an upper portion in FIG. 6) with the porous substance 12. Accordingly, the pore diameter of the porous member 36'" decreases toward the contact portion with porous substance 12; that is, capillary attraction of the porous member 36'" increases toward the contact portion. As a result, the seal liquid 14 concentrates in the contact portion with the porous substance 12 and a state in which permeation ratio is 100% or more is formed in the neighborhood of the contact portion.

Although, in the supplying units 38" and 38'", the pore diameters of the porous members 36" and 36'" are changed by compressing the porous members to change capillary attractions, the same effect is obtained also by using porous members whose pore diameters are continuously changing. Although, in the supplying unit 38'", ribs formed inside the container 34' are used as a compression unit that compresses the porous member 36'", the present invention is not limited to this configuration; for example, the lid 40 may be used as a compression unit, or the lid 40 may be provided with a compression unit. An embodiment of a supplying unit, without being limited to ribs, may also be projections formed on side walls. Depending on the position at which the porous substance and the porous member contact, the position of the supplying unit, a rib shape, and the like may be designed so that a seal liquid concentrates at a contact portion between the porous substance and the porous member.

Figure 7A:
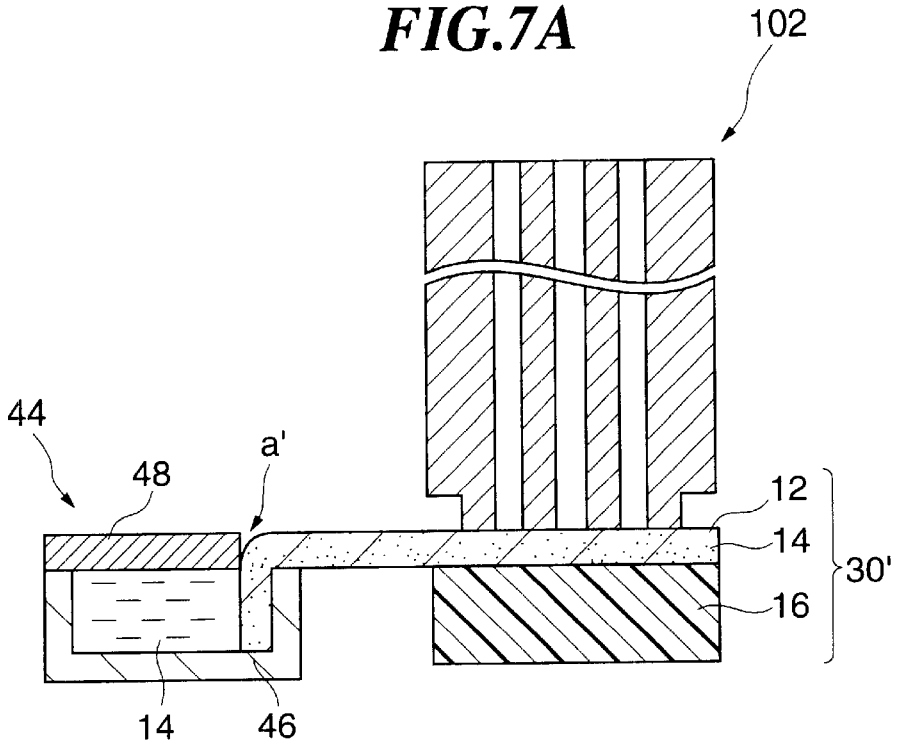
FIGS. 7A and 7B are schematic cross-sectional views showing an embodiment of the ink drying prevention apparatus of the present invention.
Figure 7B:
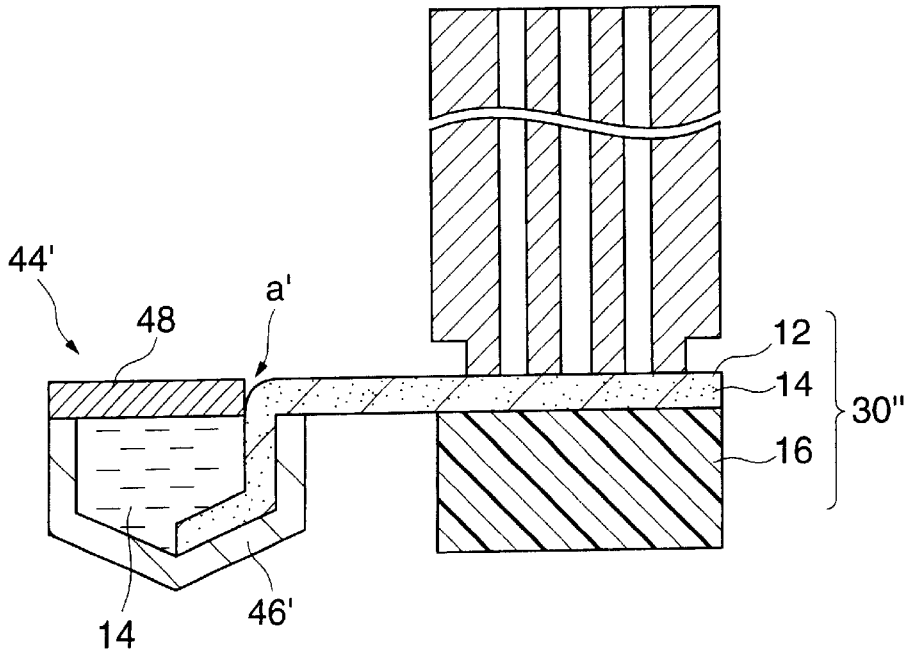

FIGS. 7A and 7B show another embodiment of an ink drying prevention apparatus having a supplying unit. Members shown in the drawings that are identical to members shown in FIG. 2 are identified by the same reference numbers, and detailed descriptions thereof are omitted.

Ink drying prevention apparatuses 30' and 30" are equivalent to the ink drying prevention apparatus 10' to which supplying units 44 and 44' are further added. The supplying unit 44 of the ink drying prevention apparatus 30' includes a container 46 having a required capacity capable of holding the seal liquid 14. The container 46 is almost sealed by a lid 48 to prevent internal a seal liquid 14 from leaking. A tip of the porous substance 12 is immersed in the seal liquid contained in the container 46 and the seal liquid 14 is supplied to the porous substance 12. An extension part a' of the porous substance 12 is formed at part of the lid 48. The supplying unit 44' of the ink drying prevention apparatus 30" includes a container 46' having a required capacity capable of holding the seal liquid 14, and the container 46' is almost sealed by the lid 48. The container 46' is smaller in the area of a lower base than in the area of an upper base and the porous substance 12 reaches the lower base of the container 46'. Even if the amount of the seal liquid 14 within the container 46' decreases because of long-term use, the porous substance 12 can be permeated with the seal liquid for a long period of time.

It is desirable that the extraction part a' formed on the lid 48 has a such a size that the seal liquid 14 does not leak and the supply of the seal liquid to the porous substance 12 at the extraction part a' is not prevented. From this point of view, it is desirable that the containers 46 and 46' are designed so that the porous substance 12 is compressed by the lid 48 at a compression ratio of about 1 to 50%. Packing or the like may be provided between the porous substance 12 and the lid 48 to prevent the seal liquid 14 from leaking.

Although the ink drying prevention apparatus of the above embodiment has a configuration in which the supporter of the porous substance separates from the container of the supplying unit, for example, the supporter of the porous substance and the container of the supplying unit may be integrally formed.

[Ink-jet Recording Head Storage Container]

Hereinafter, an embodiment of an ink-jet recording head storage container of the present invention will be described using the accompanying drawings. Members shown in the drawings that are identical to members shown in FIGS. 2 to 4 are identified by the same reference numbers, and detailed descriptions thereof are omitted.

Figure 8:
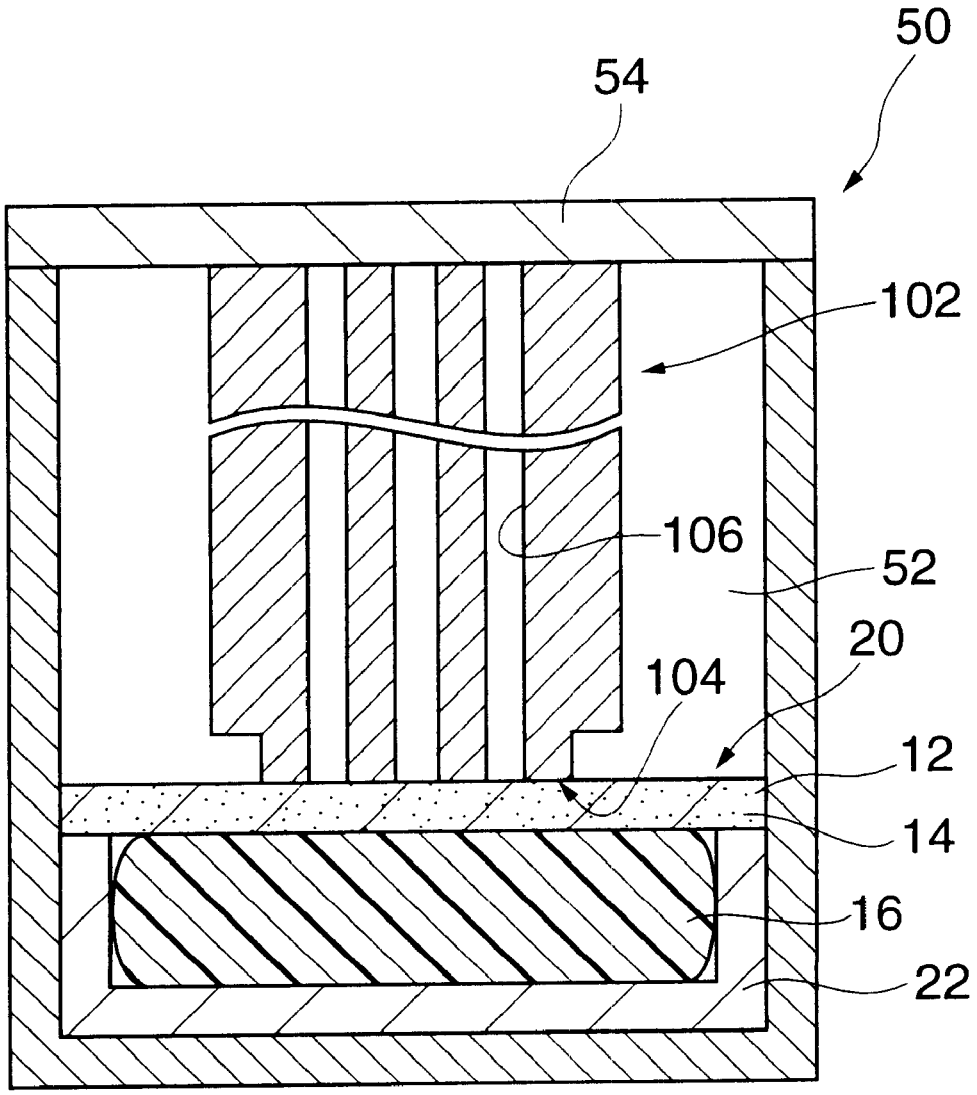
FIG. 8 is a schematic cross-sectional view showing an embodiment of the ink drying prevention apparatus of the present invention.

The ink-jet recording head storage container 50 shown in FIG. 8 includes a chamber 52 capable of housing an ink-jet recording head and an openable/closeable lid 54 provided on the top of the chamber 52. At the bottom of the chamber 52 is secured an ink drying prevention apparatus (a united ink drying prevention apparatus 20) of the present invention with the porous substance 12 facing upward. When a recording head 102 has been housed with a nozzle surface 104 facing downward, in the chamber 52, the ink nozzle surface 104 contacts the porous substance 12 of the ink drying prevention apparatus 20. Accordingly, since the nozzle surface 104 is sealed by a seal liquid as long as the recording head 102 is housed in the storage container 50, the clogging of a nozzle 106 can be prevented. Preferably, the supporter 16 of the ink drying prevention apparatus 20 is made of a deformable material such as an elastic substance so that the supporter 16 deforms on a press of the recording head 102 and the contact between the nozzle surface 104 and the porous substance 12 is made more intimate. Moreover, it is desirable that the shielding member 18 is disposed between the supporter 16 and the porous substance 12 (e.g., the ink drying prevention apparatus 20') because a seal liquid contained in the porous substance 12 moves to the supporter 16 over time, preventing the ink drying prevention function from being impaired.

Although the storage container 50 including the chamber 52 capable of housing the entire recording head 102 is shown in the above embodiment, the storage container of the ink-jet recording head of the present invention need not include a chamber capable of housing the entire recording head and has only to have a capacity large enough to house a tip (a tip having a nozzle surface) of the recording head. For example, if a tip of the recording head is convex and the convex tip face is a nozzle surface, the storage container may also be configured to include a chamber capable of housing the convex portion (while bringing the nozzle surface into contact with the ink drying prevention apparatus).

Although a storage container in which a recording head is housed with a nozzle surface facing downward is shown in the above embodiment, the present invention is not limited to the embodiment; a storage container of the present invention may also be one in which a recording head can be housed with a nozzle surface facing upward, or with a nozzle surface facing horizontally.

It is desirable that an ink-jet recording head storage container of the present invention includes a holding unit that can hold a nozzle surface of a recording head in contact with a porous substance of an ink drying prevention apparatus because the contact between the porous substance and the nozzle surface can be kept intimate regardless of application of impacts and vibrations to the storage container, preventing the ink drying prevention function from degrading. The holding unit may be configured with, e.g., a groove or guide plate for guiding insertion of the recording head, formed in a chamber for housing the recording head. An elastic substance such as a flat spring, spring, and rubber can also be used which press the nozzle surface of the recording head against the ink drying prevention apparatus. It is desirable that an elastic member is used because it helps to make the contact between the porous substance and the nozzle surface more intimate.

Desirably, the ink-jet recording head storage housing of the present invention has an ink drying prevention apparatus provided with a supplying unit to prevent ink within the recording head from drying, for a longer period of time and more stably.

[Ink-jet Recording Apparatus]

Figure 9:
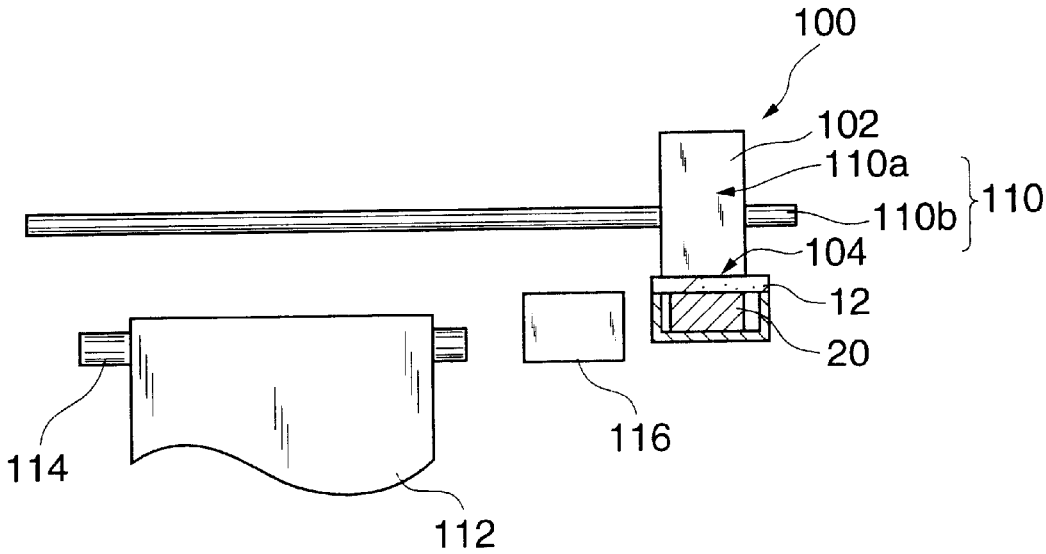
FIG. 9 is a schematic cross-sectional view showing an embodiment of an ink-jet recording apparatus of the present invention.

FIG. 9 shows an embodiment of an ink-jet recording apparatus of the present invention. Members shown in the drawings that are identical to members shown in FIGS. 2 to 4 are identified by the same reference numbers, and detailed descriptions thereof are omitted.

The ink-jet recording apparatus 100 of the present embodiment shown in FIG. 9 includes: an ink-jet recording head 102; a control unit (not shown) that controls a jet unit (not shown) disposed within the head 102 according to an image signal; a moving unit 110 that moves the head 102 according to the image signal; and a feeding unit 114 such as an auto sheet feeder that feeds recording paper 112. The moving unit 110 includes: a carriage part 110*a* provided with the head 102; and a carriage shaft 110*b* secured to an outside frame (not shown) that supports a carriage part 110*a* so as to be movable horizontally in the drawing. The ink drying prevention apparatus 20 is positioned in the neighborhood of a standby area of the head 102 and the porous substance 12 containing a seal liquid is supported so as to be contactable with the nozzle surface 104. A cleaning unit 108 having a blade and the like is disposed in the neighborhood of the ink drying prevention apparatus 20 to eliminate a seal liquid deposited on the nozzle surface when the recording head 102 moves to a printed area.

When the ink-jet recording apparatus 100 enters non-printed mode or is powered off, the recording head 102 returns to a standby area. When the recording head 102 is positioned in the standby area, the ink drying prevention apparatus 20 is pressed in the direction of the nozzle surface 104 of the recording head 102 so that the porous substance 12 is brought into contact with the nozzle surface 104. Since the porous substance 12 contains a seal liquid, a large number of meniscuses of the seal liquid are formed on the nozzle surface 104 and break contact with the air, so that a nozzle is not clogged. Accordingly, nozzle clogging can be eliminated that has been conventionally occurring when the ink-jet recording apparatus is powered off or has been in nonprinted mode for a long period of time.

It is desirable that the ink-jet recording apparatus of the present invention includes: an ink drying prevention member that, when not ejecting ink, brings the ink drying prevention apparatus into contact with the nozzle surface, while, when ejecting ink, separating the ink drying prevention apparatus from the nozzle surface; and a unit that adjusts a distance from the recording head. As the unit, a cam-based distance adjusting unit or a distance adjusting unit by use of a drive solenoid is available.

It is preferred that the contact angle of the seal liquid to the nozzle surface 104 near the ink jet orifices (not shown) of the recording head 102 is greater than that to the surface of the porous substance. When the contact angle of the seal liquid satisfies the above relationship, the seal liquid is repelled much more from the nozzle surface 104 near the ink jet orifices than from the porous substance 12. Thus, for example, when the recording head 102 is taken out from the ink drying prevention apparatus for using the recording head 102, most of the seal liquid that has formed a meniscus between the porous substance 12 and the nozzle surface 104 is moved to and remained in the porous substance 12 than to the nozzle surface 104 according to the movement of the remove of the recording head 102 from the porous substance.

In order to set the relationship of the contact angle described above, for example, the nozzle surface 104 at least near the ink jet orifices of the recording head 102 may be treated with an ink repelling treatment. As the ink repelling treatment method, for example, a method for applying and drying a coating liquid dissolving a fluorine contained polymers to the nozzle surface near the ink jet orifices, a method for printing and baking a fluorine contained polymers to the nozzle surface near the ink jet orifices and a method for eutectoid plating the nozzle surface near the ink jet orifices in a fluorinated atmosphere or the like may be used. The contact angle of the seal liquid to the nozzle surface 104 not near to the ink jet orifices may not be greater than that to the porous substance, it may be smaller or equal to the contact angle to the porous substance. However, it is preferred that contact angle of the seal liquid to the whole nozzle surface 104 is set to greater than to the porous member 12, in other word, the whole area of the nozzle surface is treated with the ink repelling material, since the seal liquid is hard to remain on the whole area of the nozzle surface 104 and contrary, most of the seal liquid is remained in the porous member 12 when the recording head 102 is removed form the surface of the porous substance 12. Thus, the total amount of the seal liquid to be remained on the nozzle surface is minimized and consumed amount of the seal liquid is also minimized.

Desirably, the ink-jet recording apparatus of the present invention has an ink drying prevention apparatus provided with a supplying unit to prevent ink within the recording head from drying, for a longer period of time and more stably.

[Embodiments]

[First embodiment] (Ink Drying Prevention Apparatus by PTFE Resin Film)

A PTFE resin film (surface tension $\gamma_p$=18 mN/m) made porous by uniaxial stretching was provided. The porous film was a burned product subjected to thermal processing beyond the melting point of the resin, and had an average pore diameter of 1.0 $\mu$m, a porosity of 80%, and a thickness of 85 $\mu$m. The contact angle of aqueous dye ink used below (surface tension $\gamma_i$=40 mN/m, kinematic viscosity 3 $mm^2/s$) in the surface of the porous PTFE resin was 100°. The porous film was cut to a size with 60 mm long in a stretching direction and 20 mm wide vertically to the stretching direction and was dipped in silicon oil (surface tension $\gamma_\epsilon$=20 mN/m, kinematic viscosity 20 $mm^2/s$) for one minute. Thereafter, surplus silicon oil deposited on the porous film surface was eliminated with dry filter paper. The initial ratio of silicon oil permeating the porous film to the total pore volume thereof was 80% by volume. The contact angle of the silicon oil in the surface of the porous PTFE resin was 5°. The contact angle of the silicon oil in the nozzle surface of a recording head used below was 5° or less, and the contact angle of aqueous dye ink used below to the silicon oil was 100° or more.

The contact angle $\theta_s$ of the seal liquid used to the bulk (not porous substance) of a PTFE resin was 35°. The surface of the PTFE resin substrate was coated with the seal liquid, and then the aqueous dye ink was put on top of it; a measured contact angle $\phi_i$ was 70°. That is, materials of the seal liquid, the porous substance, and ink which were used satisfied the following expression.

$$\gamma i \times \cos \phi i = 13.7 \text{ mN/m} < \gamma s \times \cos \theta s = 16.4 \text{ mN/m}$$

To produce an ink drying prevention apparatus having the same configuration as that in FIG. 2, the porous film holding the silicon oil was secured to a supporter, made of a polyurethane foam (average pore diameter 0.1 mm, elastic modulus 100 kPa), which is 40 mm long, 20 mm wide, and 10 mm thick, by nipping each end in a stretching direction with a supporting member (not shown). The ink drying prevention apparatus, with the porous film face facing upward, was secured on a desk.

Next, a recording head was provided. The recording head had a nozzle surface of 25 mm long by 8 mm wide, and 300 jet orifices, each 30 $\mu$m in pore diameter, were disposed on the nozzle surface. The nozzle within the recording head was charged with aqueous dye ink, which was exposed to ink jet orifices. The recording head, with the nozzle surface facing downward, was secured so that the nozzle surface and the face of the porous film were opposed to be almost parallel to each other and brought into contact. In this state, the ink drying prevention apparatus was left intact for three months in a room kept at a temperature of 20° C. and a relative humidity of 50%. Thereafter, the recording head was removed from the ink drying prevention apparatus and attached to an ink-jet recording apparatus to perform a printing test. As a result, it could be confirmed that satisfactory printed images could be formed by only performing ordinary maintenance processes (wiping and dummy jet).

An ink drying prevention apparatus was produced in the same way as in the first embodiment, except that a porous film dipped in silicon oil (surface tension $\gamma_\epsilon$=20 mN/m, kinematic viscosity 20 mm$^2$/s) for one minute was used without eliminating surplus silicon oil deposited on the porous film surface. The initial ratio of silicon oil permeating the porous film to the total pore volume thereof exceeded 100% by volume. It was found from observation of the porous film surface that a large amount of silicon oil permeated the porous film surface.

Except that the ink drying prevention apparatus used in the first embodiment was replaced by the above apparatus, after the recording head was left intact in the same condition as in the first embodiment, a printing test was performed in the same condition as in the first embodiment. As a result, although formed images were satisfactory, it was found from enlarged printed dots of an image part that dots having low ink density were partially contained. That is probably because a seal liquid excessively existing on the porous film surface invaded into the nozzle from the jet orifices when the recording head had been left intact, and part of the seal liquid mixed with ink. However, since the mixed a seal liquid separated from the ink without becoming compatible with it, the mixed a seal liquid could be eliminated by performing a dummy jet before starting printing and image recorded after the dummy jet were satisfactory. However, a small amount of ink was wasted. Accordingly, to stably form images of high quality without wasting the ink and the like, it is desirable that the permeation ratio of a seal liquid to the porous film does not exceed 100%.

The nozzle surface of the ink-jet recording head used in the first embodiment was subjected to water repellency processing by coating it with a fluorocarbon resin solution, drying it, and baking it. The contact angle of the seal liquid used in the first embodiment to the nozzle surface after the water repellency processing was 60°. The contact angle is greater than the contact angle 5° of the seal liquid to the porous substance in the first embodiment. Using a recording head subjected to water repellency processing in the nozzle surface and a recording head not subjected to water repellency processing in the nozzle surface, the contact angle of the seal liquid to the nozzle surface is not more than 3°, was performed by the ink drying prevention apparatus of the first embodiment. Respective recording head is repeatedly contacted to and removed from the surface of the porous substance and the total amount of the consumed seal liquid of respective head is estimated. By comparing the amount of the consumed seal liquid, the total amount of the consumed seal liquid for used to the treated recording head is much smaller than that to the non-treated reacording head. In addition, after the contacting and removing test, actual recording test is performed to estimate recording quality of respective recording head. Though by eye-examination of the recording quality, each recording qualities are almost same and fairly good, by scrutiny of the recording quality byenlarging the recorded member, recording dots formed by repelling treated head has less deviation on their dots diameter and recorded position thereof than them recorded by non-treated head. After the removing action, nozzle surfaces of each recording heads are magnifiedly observed to be found that remained seal liquid is hard to found on the nozzle surface of the treated recording head and remained seal liquid is observed in a small quantity on the surface of the recording head of the non-treated head. Thus, it is found that when the contact angle of the seal liquid to the surface of the nozzle surface is greater than that to the porous substance, the amount of the seal liquid to be remained on the surface of the recording head is diminished and effect of the remained seal liquid affecting to ink jetting of the ink is also be diminished.

COMPARISON EXAMPLE 1

Using an ink drying prevention apparatus provided with a enclosed rubber cap in place of the ink drying prevention apparatus used in the first embodiment, after a recording head was left intact in the same condition in the first embodiment, a printing test was performed in the same condition as in the first embodiment. Since the recording head having been left intact was clogged, printing was difficult. Normal printing could be performed by repeating maintenance for the clogging of a vacuum and the like and test printing several times. However, this brought about the result that several-minute wait time was required and paper and ink of an ink tank for test printing were wastefully discarded.

COMPARISON EXAMPLE 2

Except that silicon oil used as a seal liquid in the first embodiment was replaced by a diethylene glycol aqueous solution (surface tension $\gamma_s$=20 mN/m) containing a solution of a slight fluoric surface-active agent, an ink drying prevention apparatus was produced in the same way as in the first embodiment. Except that the ink drying prevention apparatus used in the first embodiment was replaced by the above apparatus, after the recording head was left intact in the same condition as in the first embodiment, a printing test was performed in the same condition as in the first embodiment. The diethylene glycol aqueous solution was compatible with the ink used in the printing test and had an affinity for the ink. It was found from the result of the printing test that a dot disturbance occurred in printed images. Moreover, it was found from enlarged printed dots that ink blurred in the circumference of the printed dots. This is probably because, since the diethylene glycol aqueous solution was compatible with aqueous ink, the aqueous solution invaded into a nozzle when the recording head had been left intact, with the result that the nature of the ink was changed.

[Second Embodiment] (Ink Drying Prevention Apparatus by Polyolefin Film)

A polyolefin resin film (surface tension $\gamma_p$=30 mN/m) made porous by uniaxial stretching was provided. The resin film had an average pore diameter of 0.2 $\mu$m, a porosity of 46%, and a thickness of 40 $\mu$m. The contact angle of aqueous dye ink used below (surface tension $\gamma_i$=40 mN/m, kinematic viscosity 3 $mm^2/s$) in the surface of the porous polyolefin resin was 100°. The porous film was cut to a size with 60 mm long in a stretching direction and 20 mm wide vertically to the stretching direction and was dipped in silicon oil (surface tension $\gamma_\epsilon$=20 mN/m, kinematic viscosity 20 $mm^2/s$) for one minute. Thereafter, surplus silicon oil deposited on the porous film surface was eliminated with a dry nonwoven fabric. The initial ratio of silicon oil permeating the porous film to the total pore volume thereof was 80% by volume. The contact angle of the silicon oil in the surface of the porous polyolefin resin was 5°. The contact angle of the silicon oil in the nozzle surface of a recording head used below was 5° or less, and the contact angle of aqueous dye ink used below to the silicon oil was 100° or more.

To produce an ink drying prevention apparatus having the same configuration as that in FIG. 2, the porous film holding the silicon oil was secured to a supporter, made of a polyurethane foam (average pore diameter 0.1 mm, elastic modulus 100 kPa), which is 40 mm long, 20 mm wide, and 10 mm thick, by nipping each end in a stretching direction with a supporting member (not shown). The ink drying prevention apparatus, with the porous film face facing upward, was secured on a desk.

Next, a recording head was provided. The recording head had a nozzle surface of 25 mm long by 8 mm wide, and 300 jet orifices, each 30 $\mu$m in pore diameter, were disposed on the nozzle surface. The nozzle within the recording head was charged with aqueous dye ink, which was exposed to ink jet orifices. The recording head, with the nozzle surface facing downward, was secured so that the nozzle surface and the face of the porous film were opposed to be almost parallel to each other and brought into contact. In this state, the ink drying prevention apparatus was left intact for three months in a room kept at a temperature of 20° C. and a relative humidity of 50%. Thereafter, the recording head was removed from the ink drying prevention apparatus and attached to an ink-jet recording apparatus to perform a printing test. As a result, it could be confirmed that satisfactory printed images could be formed by only performing ordinary maintenance processes (wiping and dummy jet).

[Third Embodiment] (Drying Prevention Apparatus by Unbaked PTFE Film)

An unbaked (not subjected to thermal processing beyond a melting point of resin) fluorocarbon resin film (surface tension $\gamma_p$=18 mN/m) made porous by extracting additives from PTFE laminated by rolling was provided. The fluorocarbon resin film had an average pore diameter of 2.0 $\mu$m, a porosity of 50%, and a thickness of 100 $\mu$m. The contact angle of aqueous dye ink used below (surface tension 40 mN/m, kinematic viscosity 3 $mm^2/s$) in the surface of the porous fluorocarbon resin was 100°. The porous film was cut to a size with 60 mm long in a stretching direction and 20 mm wide vertically to the stretching direction and was dipped in silicon oil (surface tension $\gamma_\epsilon$=20 mN/m, kinematic viscosity 20 $mm^2/s$) for one minute. Thereafter, surplus silicon oil deposited on the porous film surface was eliminated with a dry nonwoven fabric. The initial ratio of silicon oil permeating the porous film to the total pore volume thereof was 80% by volume. The contact angle of the silicon oil in the surface of the porous fluorocarbon resin was 5°. The contact angle of the silicon oil in the nozzle surface of a recording head used below was 5° or less, and the contact angle of aqueous dye ink used below to the silicon oil was 100° or more.

To produce an ink drying prevention apparatus having the same configuration as that in FIG. 2, the porous film holding the silicon oil was secured to a supporter, made of a polyurethane foam (average pore diameter 0.1 mm, elastic modulus 100 kPa), which is 40 mm long, 20 mm wide, and 10 mm thick, by nipping each end in a stretching direction with a supporting member (not shown). The ink drying prevention apparatus, with the porous film face facing upward, was secured on a desk.

Next, a recording head was provided. The recording head had a nozzle surface of 25 mm long by 8 mm wide, and 300 jet orifices, each 30 $\mu$m in pore diameter, were disposed on the nozzle surface. The nozzle within the recording head was charged with aqueous dye ink, which was exposed to ink jet orifices. The recording head, with the nozzle surface facing downward, was secured so that the nozzle surface and the face of the porous film were opposed to be almost parallel to each other and brought into contact. In this state, the ink drying prevention apparatus was left intact for three months in a room kept at a temperature of 20° C. and a relative humidity of 50%. Thereafter, the recording head was removed from the ink drying prevention apparatus and attached to an ink-jet recording apparatus to perform a printing test. As a result, it could be confirmed that satisfactory printed images could be formed by only performing ordinary maintenance processes (wiping and dummy jet).

[Fourth Embodiment] (Embodiment of Shielding Member)

Except that a film (15 $\mu$m thick) made of PET was disposed between a porous film and an urethane foam and secured with an adhesive, an ink drying prevention apparatus was produced in the same way as in the first embodiment. The ink drying prevention apparatus could prevent the permeation of silicon oil into the urethane foam for a longer period of time.

[Fifth Embodiment] (Embodiment Having Supplying Unit)

Figure 10:
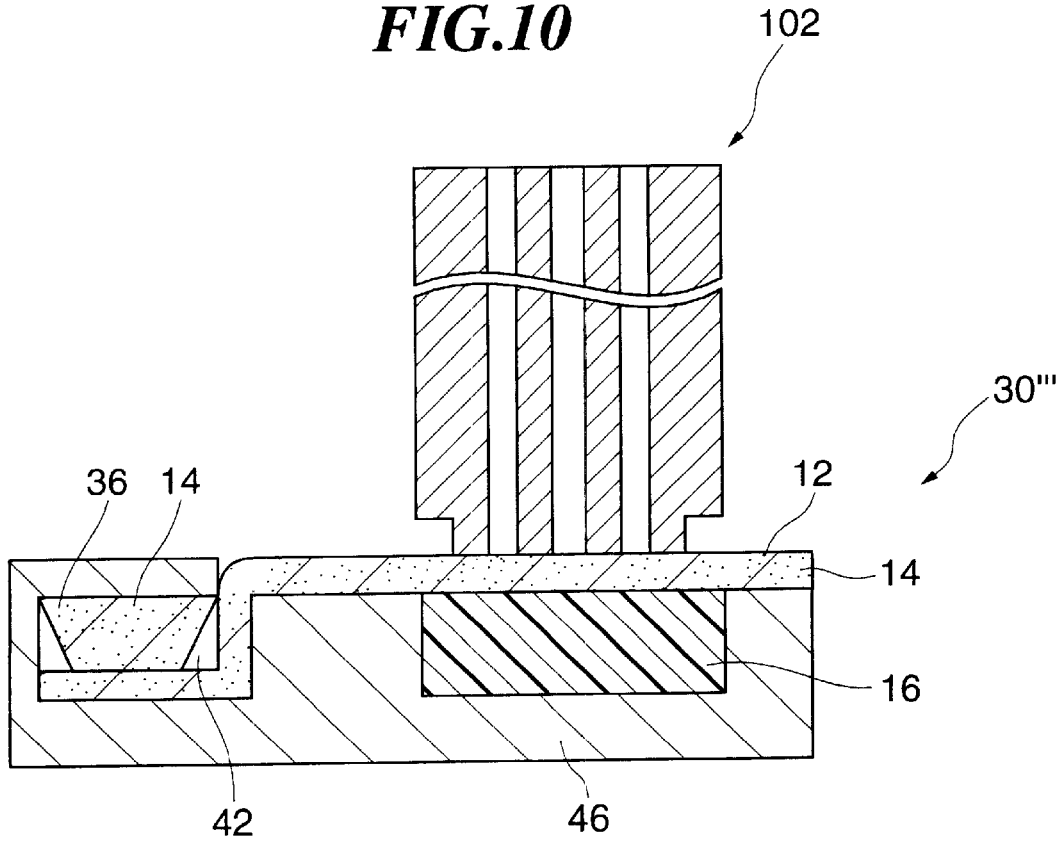
FIG. 10 is a schematic cross-sectional view showing the ink drying prevention apparatus used in a fifth embodiment.

An ink drying prevention apparatus 30''' shown in FIG. 10 was produced. For a seal liquid 14, a porous film 12, and a supporter 16, the same materials as used in the first embodiment were used. A porous film 12 was disposed at the bottom and side wall of a concave part 46*a* of an outside frame 46 and a porous member 36 holding a seal liquid 14 in contact with the porous film was placed. As the porous member 36, a polyethylene foam having an average pore diameter of 0.1 mm, which is 20 mm wide, 30 mm long, and 5 mm thick, was provided, and the polyethylene foam was charged with 1.8 g of a seal liquid 14 so that the permeation ratio of the seal liquid was 60% of that during no compression. By disposing the porous member 36 in the concave part of the outside frame 46, the porous member 36 was compressed by a rib 42, with the result that the permeation ratio of the seal liquid was 100% at a contact portion between the porous member 36 and the porous film 12.

After the recording head was left intact in the ink drying prevention apparatus 30'" in the same condition as in the first embodiment, a printing test was performed in the same condition as in the first embodiment, with the result that satisfactory results were obtained similarly. Moreover, the clogging of the recording head was checked by repeatedly mounting and dismounting the recording head in and from the ink drying prevention apparatus 30'" to observe the presence of clogging of ink in the recording head. Though a printing test was performed after mounting and dismounting the recording head 1000 times, no clogging was observed. This is probably because a sufficient amount of the seal liquid always existed at a contact portion between the porous film 12 and the nozzle surface because the seal liquid was successively supplied from the porous member 36. Provided that the recording head is mounted and dismounted typically 10 times to a month, the ink drying prevention apparatus of the present embodiment can probably prevent the clogging of the recording head for about 100 months.

[Sixth Embodiment] (Embodiment Having Supplying Unit)

An ink drying prevention apparatus 30" shown in FIG. 7 was produced. After the recording head was left intact in the ink drying prevention apparatus 30" in the same condition as in the first embodiment, a printing test was performed in the same condition as in the first embodiment, with the result that satisfactory results were obtained similarly. Mounting/dismounting tests were performed on the recording head as in the fifth embodiment. Although mounting/dismounting operations were repeated 1000 ties as in the fifth embodiment, poor printing due to the clogging of the recording head was not observed.

According to the present invention, an ink drying prevention apparatus, an ink-jet recording head storage container, an ink drying prevention method can be provided which can prevent ink within an ink-jet recording head from drying for a long period of time. Also, according to the present invention, there can be provided an ink-jet recording apparatus that can prevent degradation in printing quality and disabled printing due to dried ink within the ink-jet recording head.

The entire disclosure of Japanese Patent Application No. 2000-253608 filed on Aug. 24, 2000 including specification, claims, drawings and abstract is incorporated herein by reference in its entirety.

What is claimed is:

1. An ink drying prevention apparatus that prevents ink within an ink-jet recording head from drying, including a porous substance permeated with a seal liquid that is nonvolatile and incompatible with the ink within the head, wherein the porous substance can contact a nozzle surface of the ink-jet recording head, a deformable supporter having a surface affixed on the porous substance, wherein the supporter is made of a material that absorbs the seal liquid, and a shielding member integrally formed on the surface of the supporter to prevent the seal liquid permeated in the porous substance from being absorbed to the supporter.

2. The ink drying prevention apparatus according to claim 1, wherein the supporter is formed of an elastic substance.

3. The ink drying prevention apparatus according to claim 1, wherein the porous substance is formed of an extensible member.

4. The ink drying prevention apparatus according to claim 1, wherein the porous substance has ink repellency.

5. The ink drying prevention apparatus according to claim 1, further including a supplying unit that supplies the seal liquid to the porous substance.

6. An ink-jet recording head storage container including the ink drying prevention apparatus according to claim 1.

7. The ink-jet recording head storage container according to claim 6, wherein the ink drying prevention apparatus is supported so as to be contactable with the nozzle surface.

8. An ink-jet recording apparatus including the ink-jet recording head storage container according to claim 7, further comprising a unit that, when ink is not jetted, brings the porous substance of the ink drying prevention apparatus into contact with the nozzle surface, and when ink is jetted, separates the porous substance from the nozzle surface.

9. An ink drying prevention apparatus that prevents ink within an ink-jet recording head from drying, including a porous substance permeated with a seal liquid that is nonvolatile and incompatible with the ink within the head, wherein the porous substance can contact a nozzle surface of the ink-jet recording head, and wherein the surface tensions of the porous substance and the seal liquid are smaller than that of the ink.

10. An ink drying prevention apparatus that prevents ink within an ink-jet recording head from drying, including a porous substance permeated with a seal liquid that is nonvolatile and incompatible with the ink within the head, wherein the porous substance can contact a nozzle surface of the ink-jet recording head, and wherein the surface tension of the seal liquid is smaller than that of the porous substance.

11. An ink drying prevention apparatus that prevents ink within an ink-jet recording head from drying, including a porous substance permeated with a seal liquid that is nonvolatile and incompatible with the ink within the head, wherein the porous substance can contact a nozzle surface of the ink-jet recording head, and wherein the seal liquid, the porous substance, and the ink are made of materials satisfying a relational expression shown below:

$$\gamma_i \times \cos \psi_i < \gamma_s \times \cos \theta_s$$

where $\gamma_i$ designates a surface tension of the ink; $\gamma_s$, a surface tension of the seal liquid; $\theta_s$, a contact angle of the seal liquid to a bulk of the porous substance; and $\psi_i$, a contact angle of the ink to the bulk of the porous substance the surface of which is wetted by the seal liquid.

12. An ink drying prevention apparatus that prevents ink within an ink-jet recording head from drying, including a porous substance permeated with a seal liquid that is nonvolatile and incompatible with the ink within the head, wherein the porous substance can contact a nozzle surface of the ink-jet recording head, and wherein the seal liquid has a greater contact angle to the nozzle surface near jet orifices than to the surface of the porous substance.

13. An ink drying prevention apparatus that prevents ink within an ink-jet recording head from drying, including a porous substance permeated with a seal liquid that is nonvolatile and incompatible with the ink within the head, wherein the porous substance can contact a nozzle surface of the ink-jet recording head, and a supplying unit that supplies the seal liquid to the porous substance, wherein the supplying unit has a holding member that holds the seal liquid, and supplies the seal liquid to the porous substance by bringing the seal liquid held in the holding member into contact with the porous substance.

14. The ink drying prevention apparatus according to claim 13, wherein at least part of the holding member is formed of the porous member and the porous member is permeated with the seal liquid.

15. The ink drying prevention apparatus according to claim 14, wherein the pore diameter $r_i$ of the porous substance, the contact angle $\theta_1$ of the seal liquid to the bulk of the porous substance, the pore diameter $r_2$ of the porous member, and the contact angle $\theta_2$ of the seal liquid to the bulk of the porous member satisfies a relational expression shown below in a contact portion between the porous substance and the porous member:

$$\cos \theta_1/r_1 > \cos \theta_2/r_2.$$

16. The ink drying prevention apparatus according to claim 14, wherein the permeation ratio of the seal liquid in the porous member is 100% or more in the neighborhood of a contact portion between the porous member and the porous substance.

17. The ink drying prevention apparatus according to claim 16, wherein, by unevenly compressing the porous member, the seal liquid held in the porous member is made to exist biasedly at a contact portion with the porous substance, and the permeation ratio of the seal liquid is 100% or more in the neighborhood of the contact portion with the porous substance.

18. The ink drying prevention apparatus according to claim 13, wherein the holding member is of concave shape and the supplying unit supplies the seal liquid to the porous substance by immersing at least part of the porous substance in the seal liquid held in the concave part.

19. The ink drying prevention apparatus according to claim 18, wherein the cross-sectional area of a lower base of the concave shape is smaller than that of an upper base thereof.

20. An ink-jet recording apparatus including an ink-jet recording head storage container including an ink drying prevention apparatus that prevents ink within an ink-jet recording head from drying, including a porous substance permeated with a seal liquid that is nonvolatile and incompatible with the ink within the head, wherein the porous substance can contact a nozzle surface of the ink-jet recording head, and wherein the ink drying prevention apparatus is supported so as to be contactable with the nozzle surface, wherein the seal liquid has a greater contact angle to the nozzle surface near jet orifices than to a surface of the porous substance.

21. An ink drying prevention method for preventing ink within an ink-jet recording head from drying, comprising the step of:

bringing a porous substance permeated with a liquid that is nonvolatile and incompatible with ink, into contact with a nozzle surface of the recording head, wherein the liquid forms meniscuses between the porous substance and the nozzle surface;

affixing a surface of a deformable supporter on the porous substance, wherein the supporter is made of a material that absorbs the liquid; and integrally forming a shielding member on the surface of the supporter to prevent the liquid permeated in the porous substance from being absorbed to the supporter.

* * * * *